US006012317A

United States Patent [19]

Bonny et al.

[11] Patent Number: 6,012,317

[45] Date of Patent: Jan. 11, 2000

[54] ARRANGEMENT FOR THE INTERNAL HIGH-PRESSURE FORMING OF HOLLOW PROFILES

[75] Inventors: Pierre Bonny, Hamburg; Thomas Huelsberg, Rosengarten, both of Germany

[73] Assignee: DaimlerChrysler AG, Germany

[21] Appl. No.: 09/161,471

[22] Filed: Sep. 28, 1998

[30] Foreign Application Priority Data

Sep. 26, 1997 [DE] Germany ..... 197 42 443

[51] Int. Cl.[7] ..... B21D 22/10

[52] U.S. Cl. ..... 72/61; 72/61; 72/370.22

[58] Field of Search ..... 72/58, 61, 62, 72/370.22

[56] References Cited

U.S. PATENT DOCUMENTS

| | | | |
|---|---|---|---|
| 2,837,810 | 6/1958 | Ekholm | 72/58 |
| 4,393,674 | 7/1983 | Rasmussen | 72/61 |
| 5,233,854 | 8/1993 | Bowman et al. | 72/58 |
| 5,233,856 | 8/1993 | Shimanovski et al. . | |
| 5,363,544 | 11/1994 | Wells et al. | 72/62 |
| 5,445,002 | 8/1995 | Cudini et al. . | |
| 5,815,901 | 10/1998 | Mason et al. | 72/58 |

FOREIGN PATENT DOCUMENTS 43 09 680 A1 9/1994 Germany .

*Primary Examiner*—David Jones

*Attorney, Agent, or Firm*—Evenson, McKeown, Edwards & Lenahan P.L.L.C.

[57] ABSTRACT

An arrangement for the internal high-pressure forming of hollow profiles has an internal high-pressure forming tool, into whose die sinking the hollow profile can be inserted. At least one axial die has a sealing head which can be inserted with play by a section into the hollow profile. This sealing head has a support part which is provided with a pressure fluid duct and on which a sealing arrangement is held and which is rigidly connected with the axial die, and has a stop surface, which in the operative position of the sealing head rests on the face side against the end of the hollow profile. The sealing arrangement contains at least one sealing element which can be radially spread open for an allaround sealing contact on the interior side of the hollow profile. To achieve a reliable fluid high-pressure-tight sealing in a simple manner without deformation of the hollow profile, so that a forming is permitted which is secure with respect to the process relative to stable pressure conditions during internal high-pressure forming, the sealing arrangement has a supporting ring which supports the sealing element, can be axially displaceably guided on the support part relative thereto and dips into the hollow profile when the sealing head is coupled to the hollow profile. A stop body has the stop surface of the sealing ring on the hollow profile and which is fixedly connected with the supporting ring. The support part has an operating device which, when the stop body rests against the hollow profile, acts upon the sealing element in a spreading-open manner because of a further axial movement of the support part relative to the supporting ring in an interaction with the supporting ring.

13 Claims, 1 Drawing Sheet

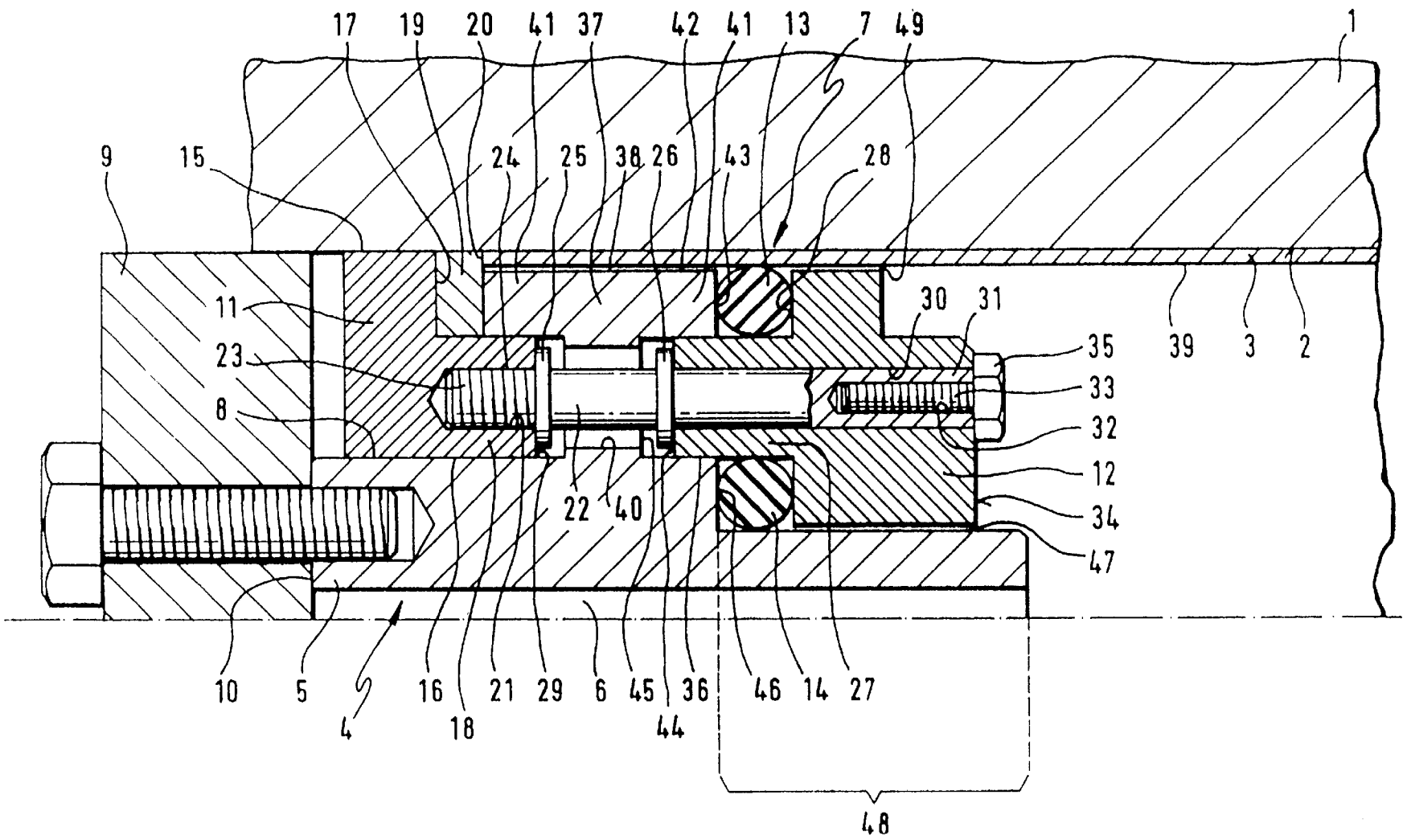
1
2
3
39
35
33
32
12
34
47
31
30
49
7
28
13
41
43
42
26
38
37
25
41
24
20
19
17
15
9
11
23
8
10
5
4
18
16
21
29
22
40
6
45
44
36
46
14
27
48

ARRANGEMENT FOR THE INTERNAL HIGH-PRESSURE FORMING OF HOLLOW PROFILES

BACKGROUND OF THE INVENTION

The present invention relates to an arrangement for the internal high-pressure forming of hollow profiles, and more particularly, to an arrangement for the internal high-pressure forming of a hollow profile, comprising an internal high-pressure forming tool, having a die sink into which the hollow profile is insertable, at least one axial die having a sealing head configured to be insertable with play into the hollow profile, which sealing head has a support part provided with a pressure fluid duct, on which support part a sealing arrangement is operatively held and which is rigidly connected with the axial die, and has a stop surface which rests in the operative position of the sealing head on the face side on the end of the hollow profile. The sealing arrangement contains at least one sealing element configured to be radially spread open for full sealing contact on an interior side of the hollow profile.

DE 43 09 680 A1 shows an arrangement in which a sealing head of an axial die is introduced in the hollow profile to be sealed and placed in the die sinking of an internal high pressure forming tool, until a radial shoulder of the sealing head stops on the face of the hollow profile. On its conically constructed end, the sealing head carries two sealing rings which are secured in the inserting direction against a sliding-out by a baffle plate mounted on the face of the end. The sealing ring close to the baffle plate is an O-ring made of a soft rubber-elastic material, while the sealing ring away from the baffle plate consists of polyamide and has a trapezoidal profile cross-section. The baffle plate is axially movably screwed to the face of the sealing head and has a bent edge, by way of which the O-ring can be acted upon. The sealing rings are constructed such that they can be introduced with a small play with respect to the hollow profile via the sealing head in a hindrance-free manner.

After the filling of the hollow profile in the known arrangement with the pressure fluid by way of the pressure fluid duct constructed in the sealing head, the sealing takes place on the basis of the internal high pressure which presses the baffle plate against the O-ring which, because of the sliding-up on the contact surface on the sealing head end which expands conically toward the axial die, spreads open and as a result presses radially against the hollow profile. Under the effect of the internal high pressure, the polyamide ring must also slide up on the contact surface and is then clamped because of its wedge-type construction between the contact surface and the hollow profile. Because of the thus occurring contact pressure on the hollow profile, an additional sealing of the hollow profile results. Furthermore, in this position, the polyamide ring represents a stop for the O-ring toward the axial die, thus against the inserting direction, whereby, by way of the axial contact pressure onto the polyamide ring by means of the internal-high-pressure-operated baffle plate, the O-ring deforms elastically and is further radially driven apart.

The arrangement advantageously avoids the previously customary metallic sealing which results in a plastic widening of the hollow profile and thus absolutely requires a trimming of the hollow profile which is formed to a finished state subsequently to the sealing. However, as long as no internal high pressure has built up during the filling operation, the sealing effect disadvantageously does not yet occur. This results in leakage because pressure fluid can flow off by way of the gap forming the play of the sealing rings. Furthermore, in practice, a sealing effect may or may not be achieved because the filling volume and the filling speed must be extremely high so that the baffle plate will move. Otherwise, a pressure compensation of the pressures occurs in front of and behind the baffle plate and thus there is no sealing of the hollowing profile during the internal high pressure forming. Thereby, because of the pressure drop during the process, the forming operation is not reliable. However, technically, the implementation of the indicated high filling speed or of the high filling volume is not feasible, particularly not in the case of relatively large components, such as motor vehicle axles.

SUMMARY OF THE INVENTION

An object of the present invention to further improve a forming arrangement such that, without any deformation of the hollow profile, a reliable fluid-high-pressure-tight sealing is achieved in a simple manner so that a forming is permitted which is reliable with respect to the process with respect to stable pressure ratios during internal high pressure forming.

According to the present invention, this object has been achieved by providing that the sealing arrangement comprises a is supporting ring configured to support the sealing element to be axially displaceably guided on the support part relative thereto and dips into the hollow profile when the sealing head is coupled to the hollow profile, and a stop body which has the stop surface of the sealing head on the hollow profile and which is fixedly connected with the supporting ring, and the support part has an operating device which, when the stop body rests against the hollow profile, because of further axial movement of the support part relative to the supporting ring in an interaction with the supporting ring acts upon the sealing element in a spreading-open manner.

After the stop of the stop body of the sealing head on the face of the hollow profile, the present invention permits a relative movement of the support part to the sealing arrangement. Thereby, case this sealing arrangement takes up a stationary position with respect to the hollow profile, while the support part can be pushed farther axially into the hollow profile. Because of the further inserting movement of the support part, which is opposed by the stationary supporting ring by virtue of the action upon the supporting ring and on the sealing element held thereon, a radial spreading-open of the sealing element is triggered virtually automatically because an operating device rigidly fastened on the support part.

The sealing element is pressed against the interior wall of the hollow profile, whereby a sufficient fluid-high-pressure-tight sealing of the hollow profile interior is achieved with respect to the outer environment. This takes place before the filling, so that no leakages occur. During the forming, the level of this fluid high pressure is stably maintained because the quality of the sealing is maintained to the end of the forming process. Thus, a forming of the hollow profile is possible which is process-secure as far as the constant pressure is concerned.

Furthermore, the arrangement according to the present invention prevents forming of the hollow profile end from taking place because, in this case, only a soft seal is pressed radially from the inside against the interior wall of the hollow profile. The hollow profile thus remains accurate to size and a possible trimming of the squeezed hollow profile in the coupling area of the sealing head to the hollow profile after the forming process is eliminated in a resource-saving and process-time-saving manner. By elimination of squeezing of the hollow profile, the withdrawal forces of the axial die are also considerably reduced. Because of the stop defined by the face of the hollow profile, a precise positioning of the sealing head to the hollow profile takes place automatically. A further feeding of the material without a fold formation or also only a follow-up movement of the hollow profile material and thus a guaranty of an unhindered material flow to the forming site is also achieved by the arrangement according to the invention by way of the axial contact of the stop body on the face of the hollow profile. This stop body can transmit the further feeding force of the axial die onto the hollow profile, whereas the no-failure further feeding of the hollow profile material in the case of the cited prior art is not possible because of the pressure drop within the hollow profile because of the insufficient sealing.

For sealing, the hollow profile is radially acted upon by a high force but axially is acted upon only minimally by force. The high axial forces which are required in the case of conventional axial seals, which can result in a buckling of the hollow profile, particularly of a bent pipe piece, are eliminated. Because of the radial sealing, the tolerances of the semifinished material for the hollow profiles can be dimensioned very roughly and therefore at reasonable cost because the radially effective sealing device is insensitive with respect to measurement fluctuations.

Other objects, advantages and novel features of the present invention will become apparent from the following detailed description of the invention when considered in conjunction with the accompanying drawings.

BRIEF DESCRIPTION OF THE DRAWINGS

The sole drawing FIGURE is a longitudinal sectional side view of a sealing head of the arrangement according to the present invention in an inserting position in a hollow profile without a sealing function.

DETAILED DESCRIPTION OF THE DRAWINGS

The sole FIGURE illustrates an internal high-pressure forming tool 1 at whose die (or face) sink 2 a hollow profile 3 is inserted. The internal high-pressure forming tool 1 is shown in the closed position. A sealing head 4 of a hydraulically operable axial die is pushed into the hollow profile 3, so that the material of the hollow profile 3 can be fed during the forming process for reliable process-forming at a high forming degree in the direction of the forming site.

The sealing head 4 includes a hollow-cylindrical support part 5, whose cavity forms a pressure fluid duct 6 for introducing the pressure fluid into the hollow profile 3 and is fluidically connected with a fluid high-pressure generating system. A sealing arrangement 7 is axially displaceably held on the outer circumferential surface 8 of the support part 5, and a stop plate 9 is screwed to the face 10 of the support part 5 away from the inserting direction.

The sealing arrangement 7 contains a ring-shaped stop body 11, the circumference of which follows the circumferential contour of the hollow profile. Also contained are a supporting ring 12, an outer soft rubber-elastic O-ring 13 forming the sealing element, and an inner O-ring 14 made of a material with similar characteristics as the O-ring 13. However, the O-ring may also be made of a spring steel.

With the exception of a slight play, the stop body 11 rests with its peripheral surface area 15 against the die sinking or face 2 of the forming tool 1 and with its inner wall 16 against the outer circumferential surface 8 of the support part 5. On its face 17 pointing in the inserting direction, the stop body 11 has a coaxially situated sleeve-shaped extension 18 of a smaller diameter than that of the stop body 11. The extension 18 circumferentially carries a ring disk in a strong press fit which is made of a highly wear-resistant material and forms a pressure piece 19 which rests against the face 17 of the stop body 11. In the inserted position of the sealing head 4 into the hollow profile 3, the pressure piece 19 rests against the face 20 of the hollow profile 3.

The projection 18 extending in the inserting direction has a threaded bore 21 of the type of a pocket bore originating from its face, which points in the inserting direction, and extending parallel to the inserting direction. A pin 22 is screwed into the threaded bore 21 by external thread 24 situated on one end 23 thereof. This pin 22 forms the connection element between the stop body 11 and the supporting ring 12. For the defined positioning of the stop body 11 on the pin 22, the latter has a circular shoulder 25 against which the stop body 11 rests.

The pin 22 has another circular shoulder 26 which is axially spaced with respect to the ring circular shoulder 25 and on which a sleeve-shaped projection 27 of the supporting ring 12 rests on the face side which, by way of a smaller diameter than that of the supporting ring 12, is coaxially arranged on the face 28 of the supporting ring 12 which points against the inserting direction. In addition, the inner circumference as well as the outer circumference 36 of the projection 27 of the supporting ring 12, in their connection position, are aligned with the corresponding circumferences of the projection 18 of the stop body 11. With respect to the inner circumference of the projections 18 and 27 of the supporting ring 12 and of the stop body 11, which have the same form and configuration, a collinear guidance can be implemented on the support part 5, which is simple to the manufacture. The projection 27 of the supporting ring 12 has a passage 30 together with the supporting ring 12 which is coaxial with respect to the threaded bore 21 of the stop body 11. The passage 30 allows the supporting ring 12 to be fitted onto the pin 22 until it rests against the circular shoulder 26.

The supporting-ring-side end 31 of the pin 22 has an internal thread 32, whereby the screwing-in of a suitable screw 33 allows the supporting ring 12 to be screwed between the circular shoulder 26 and the screw head 35 from the face 34 of the supporting ring 12 pointing in the inserting direction. The supporting ring 12 is therefore precisely positioned relative to the stop body 11 and also has a defined position on the pin 22. For the mechanical stability of the connection between the stop body 11 and the supporting ring 12, these two sealing arrangement elements are connected by several pins 22 distributed along their circumference. As an alternative embodiment, a screwed connection corresponding to that of the supporting ring 12 is contemplated for the stop body 11. The connection devices should, in each embodiment, be detachable from the stop body 11 and the supporting ring 12 to ensure an exchangeability of worn-out parts of the sealing arrangement 7.

The outer O-ring 13 rests in the radial direction against the outer circumference 36 of the supporting ring extension 27 and is supported in the axial direction of the supporting ring side on the face 28 of the supporting ring 12. The support part 5 has a circular shoulder 37 which is arranged between the stop body 11 and the supporting ring 12, and extends with its edge 38 close to the inner wall 39 of the hollow profile 3. This arrangement of the circular shoulder 37 close to the hollow profile or the configuration of its diameter which is such that, with respect to the hollow profile 3, a clearance fit of the circular shoulder 37 is obtained, is used for the radial supporting of the hollow profile 3 during a further feeding of the hollow profile 3 in the forming process. This arrangement avoids a folding of the hollow profile 3, which is undesirable for the forming process, in the area of the hollow profile 3 which is covered by the sealing head 4 and is not supportingly acted upon by the internal high pressure. The required pushing-after forces for the axial die are reduced since the area between the face 20 of the hollow profile 3 and the sealing element, thus the O-ring 13, is not acted upon by internal high pressure and thus no resulting frictional force must be overcome. The circular shoulder 37 therefore forms a separating wall between the stop body 11 and the supporting ring 12, in which one or several axial passages 40 are penetrated by the respective connection device, i.e., the pin 22 between the stop body 11 and the supporting ring 12.

In the axial direction, the circular shoulder 37 has a collar 41 on both sides which reaches behind the extension 27 and the extension 18 respectively and rests, on the one side, on the outer circumference 36 of the extension 27 forming the contact surface for the O-ring 13 and, on the other side, against the outer circumference of the extension 18. On its edge 42 facing the hollow profile, the collar 41 ends flush with the edge 38 of the circular shoulder 37. The collar facing the supporting ring 12 in the illustrated embodiment rests in the relaxed position of the sealing arrangement against the O-ring 13 with its face 43 pointing in the inserting direction. However, the relaxed position, this face 43 may also be axially spaced from the O-ring 13. It is important that the collar 41 is axially movably guided on the outer circumferences of the extension 18 of the stop body 11 and of the extension 27 of the supporting ring 12. In the direct contact illustrated on the drawing, the axial mobility is within the scope of the elastic deformability of the material of the O-ring 13 and of the O-ring 14. For ensuring an axial mobility of the circular shoulder 37 and thus of the support part 5 relative to the sealing arrangement 7, it is also necessary that, starting from the relaxed position of the sealing arrangement 7, a free axial displacement path exists between the face 44 of the extension 27 and the face 45 of the circular shoulder 37 pointing in the inserting direction.

After the stop body 11 rests against the face 20 of the hollow profile 3 by way of the pressure piece 19 for sealing the hollow profile 3, the support part 5 is pushed farther into the inserting direction by way of the axial die. In this case, the O-ring 13 is axially squeezed together by the collar 41 of the circular shoulder 37, whereby the O-ring 13 is radially spread apart and is pressed at a high force against the interior wall 39 of the hollow profile. The collar 41 of the circular shoulder 37 therefore forms the operating device for the sealing ring 13. The free displacement path must be so large that the O-ring 13 or generally the sealing element is compressed to an extent sufficient for a secure sealing. However, the displacement path may only be so large that the O-ring 13 is not damaged by an excessive squeezing-together. This is achieved by a suitable spacing of the stop plate 9 forming a counterstop with respect to the stop body 11 during a relative movement of the support part 5 from the stop body 11. Thereby, when the stop plate 9 rests against the stop body 11, the support part 5 fixedly connected with the stop plate 9 is fixed and no additional relative movement of the support part 5 can be carried out in the inserting direction. A suitable axial positioning of the supporting ring 12 on the pin 22 limits the displacement path in the same manner, whereby the extension 27 of the supporting ring 12 and the circular shoulder 37 form the two corresponding stops.

Because of the contact of the extensions 18, 27 on the outer circumferential surface 8 of the support part 5, the sealing arrangement 7 is disposed on the support part 5 in a stable manner with respect to tilting. On their interior walls, the extensions 18, 27 as well as the supporting ring 12 and the stop body 11 may be coated with a wear resistant sliding film, for example, of molybdenum sulfide which increases the durability of the sealing head and considerably increases the smooth movement of the sealing arrangement 7 relative to the support part 5.

Approximately at the level of the position of the O-ring 13, the support part 5 tapers all around in a step 46 on which the O-ring rests 14 which is fitted onto the support part 5. On the opposite side, the face 28 of the supporting ring 12 rests against the O-ring 14. With relative movement of the support part 5 with respect to the sealing arrangement 7 in the inserting direction, simultaneously, for the squeezing-together of the O-ring 13, the inner O-ring 14 is also acted upon in a squeezing manner because of the action upon the step 46, on one hand, and upon the face 28 of the supporting ring 12, on the other hand, as well as by the inner circumferential surface of the extension 27 of the supporting ring 12 which bounds radially to the outside. Thus, possible leakages and pressure drops during the internal high-pressure forming are avoided by way of the clearance gap 47 between the support part 5 and the supporting ring 12 fitted onto the tapered section 48 of the support part 5.

In addition, the diameter of the supporting ring 12 is dimensioned such that, although the sealing head 4 can be inserted with play into the hollow profile 3, the clearance gap 49 between the supporting ring 12 and the hollow profile 3 is size sufficiently narrow such that, for a sealing squeezing of the O-ring 13, sufficient resistance is offered by the collar 41 of the circular shoulder 37. When being acted upon in a squeezing manner, the O-ring 13 is thus not pressed over the edge of the supporting ring 12, which would result in a shearing and therefore damaging stressing of the O-ring.

Instead of using the O-ring 13, the use of an oblong elastic hollow-bored stopper is contemplated, whereby the sealing stop surface on the hollow profile 3 is considerably enlarged and thus the safety of a sufficient sealing is ensured even after a long usage time. Deviating from the cylindrical construction of the illustrated embodiment, the stop surface of the extension 27 of the supporting ring 12 for the O-ring 13 can also have a conical construction. As the result of the action of the collar 41 of the circular shoulder 37 on the O-ring 13, the O-ring is already spread open only as the result of the sliding-up on the cone which widens in the inserting direction, and is pressed onto the hollow profile wall 39, whereby the O-ring 13 must be acted upon only by a reduced squeezing force in order to achieve the required sealing which reduces the wear of the O-ring 13.

In order not to hinder the material flow during the internal high-pressure forming, the sealing head 4, together with the axial die, can simply follow the shortening hollow profile 2 to the same extent without having to accept a loss of tightness. Likewise, as required, it is possible to apply, by way of the axial die, an additional axial force onto the hollow profile so that the material flow to the forming site is forced during a high-degree forming. That is, further hollow profile material is fed to the forming site. In order to carry this out in an unhindered manner, the stop body 11 and the pressure piece 19 have a ring-shaped configuration which results in a uniform pressure strain when the sealing arrangement 7 rests by way of the stop body 11 on the face 20 of the hollow profile 3.

Within the scope of the present invention, the interaction between the support part 5 and the supporting ring 12 for the spreading-open of the O-ring can also be caused in that the support part 5 has an external toothing which meshes with an internal toothing of the supporting ring 12 such that a simple translational inserting movement of the support part 5, after the stop body 11 rests against the hollow profile 3, spreads open the supporting ring 12 in a forcibly guided manner. For this purpose, the support part 5 must have a conical construction along its toothed section, the cone tapering in the inserting direction. The supporting ring 12 is composed of different circular segments on whose outer circumference the O-ring 13 is held. The type of spreading-open can also take place by a rotational movement of the support part 5. As an alternative to the toothing, the support part 5 can also be constructed as a conical mandrel, in which the supporting ring 13 may be elastic within certain limits as a solid body but be constructed with a significantly higher Shore-hardness than the O-ring 13 or with respect to its shape, may consist of inflexible circular segments. In the latter case, the restoring force of the spread-open supporting ring 12 into the relaxed position causes the elastic redeforming force of the O-ring 13 which with respect to the circumference is inserted in the supporting ring 12 in the manner of a piston ring.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Arrangement for the internal high-pressure forming of a hollow profile, comprising an internal high-pressure forming tool having a die sink into which the hollow profile is insertable, at least one axial die having a sealing head configured to be insertable with play into the hollow profile, which sealing head has a support part provided with a pressure fluid duct, a sealing arrangement operatively held on the support part and rigidly connected with the axial die, the sealing arrangement having a stop surface which is arranged to rest in an operative position of the sealing head on a face side on the end of the hollow profile and containing at least one sealing element configured to be radially spread open for sealing contact on an interior side of the hollow profile, the at least one sealing element comprising a supporting ring configured to support the at least one sealing element so as to be axially displaceably guided on the support part relative thereto and to dip into the hollow profile with the sealing head being coupled to the hollow profile, and a stop body having the stop surface of the sealing head on the hollow profile and being fixedly connected with the supporting ring, wherein the support part has an operating device which, with the stop body in a rest position against the hollow profile, is configured to spread open the sealing element upon further axial movement of the support part relative to the supporting ring.

2. Arrangement according to claim 1, wherein the operating device comprises a circular shoulder of the support part having an axial passage, a connection device arranged to penetrate the axial passage to connect the supporting ring with the stop body, the circular shoulder being configured to extend radially between the sealing element held on the supporting ring and the stop body, and having a collar situated in an edge area thereof to reach over the stop surface such that the sealing element is arranged to be spread open by the collar which is axially movable between the sealing element and the stop body, with the stop body resting on the hollow profile.

3. Arrangement according to claim 2, wherein the stop surface of the supporting ring for the sealing element has a cylindrical configuration.

4. Arrangement according to claim 2, wherein the stop surface of the supporting ring for the sealing element has a conical-like configuration which tapers toward the circular collar.

5. Arrangement according to claim 2, wherein the stop body rests against the support part, and the stop body and the supporting ring are coated on interior walls thereof resting on the support part with a wear-resistant sliding film.

6. Arrangement according to claim 2, wherein, on a face opposite the hollow profile, the stop body has a pressure piece with a wear-resistant material.

7. Arrangement according to claim 2, wherein the supporting ring has a sleeve-shaped extension on a face thereof opposite the stop body, the face of the extension forming a counterstop for the face of the circular shoulder of the support part pointing in an inserting direction during a relative movement of the support part.

8. Arrangement according to claim 2, wherein a stop plate is fastenable to the support part and is spacedly arranged on a side of the stop body facing away from the circular shoulder and forms a counterstop with respect to the stop body during a relative movement of the support part.

9. Arrangement according to claim 2, wherein the stop body has a ring-shape configuration following the circumferential contour of the hollow profile.

10. Arrangement according to claim 2, wherein the connection device comprises a pin, having one end provided with an internal thread on which the supporting ring is fitted and has a corresponding axial passage bore which rests in the inserted position on a circular shoulder of the pin between ends of the pin, the supporting ring being screwed to the pin from a face of the supporting ring pointing in the inserting direction by a screw screwed into the internal thread of the pin, the other end of the pin having an external thread for screwing same into a threaded bore of the stop body.

11. Arrangement according to claim 2, wherein the sealing arrangement further comprises an inner sealing ring carried on an outer circumferential surface of the support part and resting against an interior circumference of the supporting ring.

12. Arrangement according to claim 1, wherein the sealing element is an O-ring comprising an elastomer or a spring steel material.

13. Arrangement according to claim 1, the sealing element is an elastic oblong stopper.

* * * * *